US005379058A

United States Patent [19]

Obu et al.

[11] Patent Number: 5,379,058

[45] Date of Patent: Jan. 3, 1995

[54] RECORDING APPARATUS USING A THERMOSENSITIVE RECORDING MEDIUM

[75] Inventors: Makoto Obu, Yokohama; Yoshihiko Hotta, Mishima; Fumihito Masubuchi, Mishima; Katsuaki Miyawaki, Yokohama; Yusuke Takeda, Yokohama; Toshio Kawakubo, Yokohama, all of Japan

[73] Assignee: Ricoh Company, Ltd., Tokyo, Japan

[21] Appl. No.: 32,655

[22] Filed: Mar. 17, 1993

[30] Foreign Application Priority Data

Mar. 19, 1992 [JP] Japan ..... 4-063037

[51] Int. Cl.[6] ..... B41J 2/32; B41M 5/28

[52] U.S. Cl. ..... 346/76 PH; 346/76 R; 346/135.1; 346/76 L; 346/108

[58] Field of Search ..... 346/76 R, 76 PH, 76 L, 346/108, 1.1, 135.1

[56] References Cited

U.S. PATENT DOCUMENTS 4,734,359 3/1988 Oguchi et al. ..... 430/945

5,157,011 10/1992 Okabe et al. ..... 503/201

*Primary Examiner*—Benjamin R. Fuller

*Assistant Examiner*—Huan Tran

*Attorney, Agent, or Firm*—Oblon, Spivak, McClelland, Maier & Neustadt

[57] ABSTRACT

A recording apparatus for recording data in a thermosensitive recording medium. The recording medium has a reversible thermosensitive recording material capable of selectively assuming one of two visible states, e.g., a cloudy state and a transparent state or a colored state and a decolored state when heated. The thermosensitive material is applied to a sheet of resin. The apparatus surely erases data written in the medium with no regard to the time elapsed and the number of times that data has been repetitively written. The cloud density or the color density is prevented from changing with no regard to the storage temperature, the time elapsed, or the number of times of writing, thereby preventing image quality from being degraded. In addition, the medium has a long service life.

14 Claims, 7 Drawing Sheets

RECORDING APPARATUS USING A THERMOSENSITIVE RECORDING MEDIUM

BACKGROUND OF THE INVENTION

The present invention relates to an apparatus for recording data in a thermosensitive recording medium provided with a reversible thermosensitive recording material capable of selectively assuming one of two visible states, e.g., a cloudy state and a transparent state or a colored state and a decolored state when heated and applied to a sheet of resin.

Thermosensitive materials of the kind described are disclosed in, for example, Japanese Patent Laid-Open Publication Nos. 154198/1980 and 414438/1990. However, the conventional thermosensitive materials have some problems left unsolved, as follows. After data has been written in the recording medium, it becomes difficult to erase the cloudy state or the colored state as the time elapses and as the number of times of repetitive writing increases. Moreover, the density of the cloud or that of the color changes with the elapse of time and with the number of times of repetitive writing, degrading the image quality. In addition, the transparent state or the decolored state also changes with the number of times of repetitive writing, limiting the durability of the medium.

SUMMARY OF THE INVENTION

It is, therefore, an object of the present invention to provide a recording apparatus capable of surely erasing the cloudy state or the colored state of the above-described kind of recording medium with no regard to the time elapsed or the number of times of repetitive writing.

It is another object of the present invention to provide a recording apparatus which insures desirable image quality by preventing the density of cloud or color from changing with no regard to the storage temperature or the time elapsed.

It is another object of the present invention to provide a recording apparatus which provides the above-described kind of recording medium with a long service life.

In accordance with the present invention, an apparatus for recording data in a thermosensitive recording medium made of a thermosensitive material which is capable of repetitively assuming a cloudy state and a transparent state when heated by particular temperatures corresponding to a data signal comprises a writing section for writing data in the recording medium by heating the recording medium with a writing member, a first heating section for heating the recording medium at a temperature which causes the recording medium to cloud, a cooling section for cooling the recording medium at a temperature lower than a temperature at which the thermosensitive material reaches a cloud density close to a maximum level, and a second heating section for heating the recording medium at a temperature which makes the thermosensitive material transparent. The first heating section, cooling section and second heating section are arranged in this order along a path for transporting the recording medium.

Also, in accordance with the present invention, an apparatus for recording data in a thermosensitive recording medium made of a thermosensitive material which is capable of repetitively coloring and decoloring when heated by particular temperatures corresponding to a data signal comprises a writing section for writing data in the recording medium by heating the recording medium with a writing member, a first heating section for heating the recording medium at a temperature which causes the thermosensitive material to color, a cooling section for cooling the recording medium at a temperature lower than an upper limit temperature which causes the thermosensitive material having colored to decolor, and a second heating section for heating the recording medium at a temperature which causes the thermosensitive material to decolor. The first heating section, cooling section and second heating section are arranged in this order along a path for transporting the recording medium.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
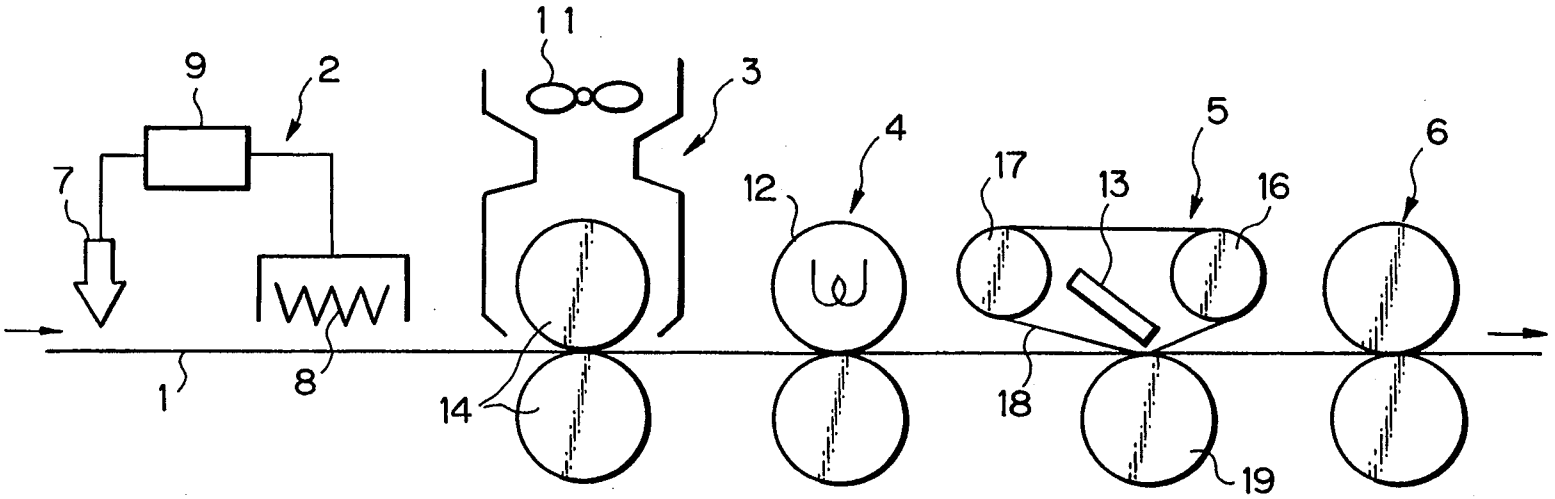
FIG. 1 is a view showing a recording apparatus embodying the present invention.

Referring to FIG. 1 of the drawings, a recording apparatus embodying the present invention is shown and includes a thermosensitive recording medium 1. The medium 1 is transported in a direction indicated by an arrow in the figure. A first heating section 2, a first cooling section 3, a second heating section 4, a thermal writing section 5, and a second cooling section 6 are sequentially arranged in this order along the transport path of the medium 1. The heating section 2 has a temperature sensor 7, a heating member 8, and a temperature control circuit 9. The cooling section 3 has a fan 11. The heating section 4 has a heating member 12. Further, the writing section 5 has a writing member 13.

The heating member 8 of the heating section 2 may be implemented by a heat resistive material coated with a conductive polymer, a ceramics semiconductor produced by adding a trace of rare-earth element to barium titanate, a heat resistive material to which indium tin oxide is applied by sputtering, or foil or fine wire of nickel chromium or tungsten covered with a heat resistive material. The heating member 8 is configured as, for example, a plate, hollow cylinder or belt in matching relation to the mechanical characteristics thereof, e.g., flexibility. The cooling section 3 includes a metallic roller pair 14 nipping the medium 1 therebetween. The roller pair 14 is cooled by a Peltier cooler and coolant. Preferably, the roller pair 14 is implemented as a heat pipe. In the writing section 5, the writing member 13 is constituted by an end type thermal head and inclined downward in the direction of medium transport. Sheet rollers 16 and 17 are located at opposite sides of the writing member 13 in the direction of medium transport. An endless heat resistive sheet 18 is passed over the rollers 16 and 17 and surrounds the writing member 13. A pressure roller 19 faces the writing member 13 with the intermediary of the sheet or belt 18.

Figure 2:
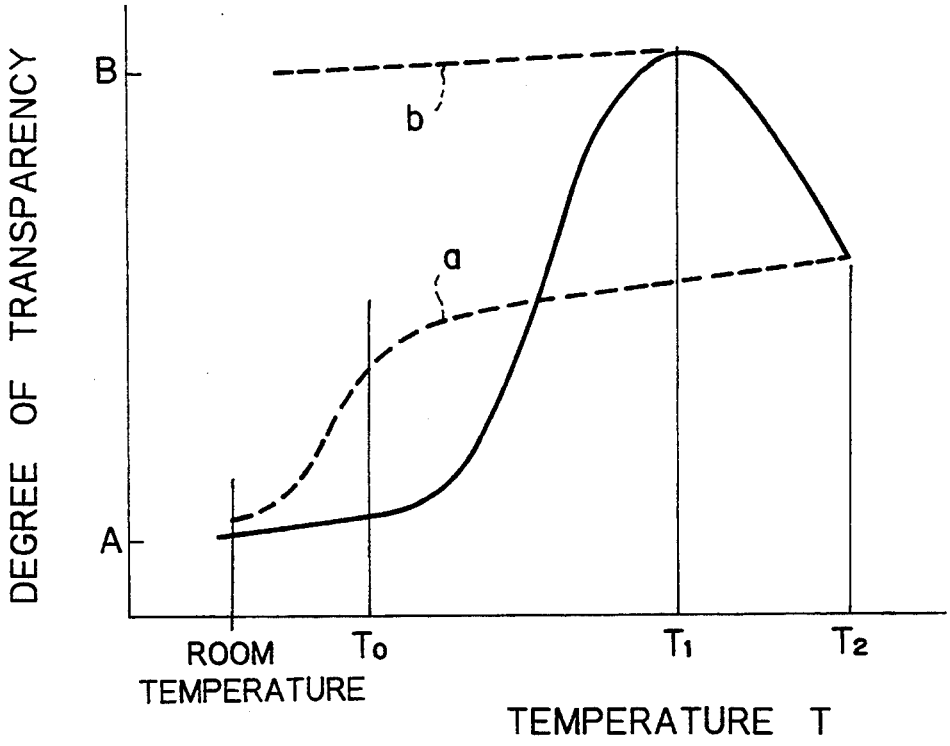
FIG. 2 is a graph indicative of a reversible characteristic of a specific thermosensitive material applicable to the embodiment.

FIG. 2 shows the reversible characteristic of a specific thermosensitive material forming part or the medium 1. In FIG. 2, the ordinate and the abscissa indicate respectively the degree of transparency (transparent or cloudy) and the temperature to which the thermosensitive material is heated. As the medium 1 in a cloudy state A is heated from room temperature to a temperature $T_1$, it is brought to a transparent state B. When the temperature is lowered from the level $T_1$ to the room level, the transparent state B is maintained, as indicated by a dotted arrow b. As the medium 1 is further heated from the temperature $T_1$ to a temperature $T_2$ and then cooled to room temperature, it becomes cloudy at a temperature $T_0$ and remains in the cloudy state A at room temperature, as indicated by a dotted arrow a. In this manner, even when the medium 1 is brought to room temperature, the two visible extreme states are insured.

Figure 3:
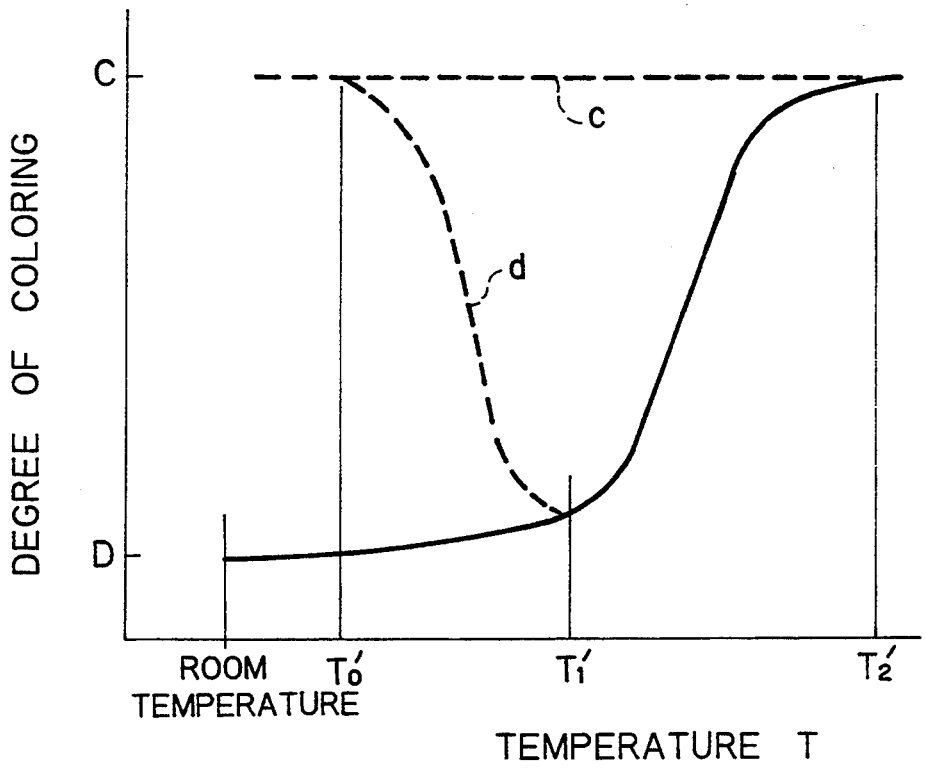
FIG. 3 is a graph indicative of a reversible characteristic of another specific thermosensitive material.

FIG. 3 indicates the reversible characteristic of another specific thermosensitive material. In FIG. 3, the ordinate and the abscissa indicate respectively the degree of coloring (colored or decolored) and the temperature to which the material is heated. As the material in a decolored state D is heated from room temperature to a temperature $T'_2$ via a temperature $T'_1$, it is brought to a colored state C. When the material is cooled from the temperature $T'_2$ to a temperature near room temperature, it maintains the colored state C, as indicated by a dotted line c. Further, as the material held in the colored state C at a temperature lower than a temperature $T'_0$ and close to room temperature is heated to $T'_1$ via $T'_0$, the density is lowered to the decolored state D, as indicated by a dotted line d. When the material is again cooled to room temperature, it maintains the decolored state D. Further, as the temperature is raised from $T'_1$ to $T'_2$, the material is again brought to the colored state C and is held in the state C even whorl the temperature is lowered to the room level.

In the illustrative embodiment, the heating section 2 heats the thermosensitive material to the temperature $T_2$ or $T'_2$. The cooling section 3 cools the thermosensitive material from the temperature $T_2$ or $T'_2$ to the range from the temperature lower than $T_0$ or $T'_0$ to the temperature near room temperature. The heating section 4 heats the thermosensitive material to the temperature $T_1$ or $T'_1$. The writing section 5 heats the thermosensitive material to the temperature $T_2$ or $T'_2$ with the heating member or thermal head 8 in response to a data signal. The cooling section 6 is installed when the distance between the writing section 5 and the position where the medium 1 will be driven out of the apparatus is short. This section 6 cools the medium 1 to a temperature low enough for the operator to easily touch it.

By heating the thermosensitive material to the temperature $T_2$ or $T'_2$ by the heating section 2, it is possible to effect the steps following the cooling section 3 under the same condition. In practice, when the medium 1 is brought into the apparatus from the outside where the temperature is −20° C. to 35° C., it is presumably of substantially the same temperature as the ambient temperature. Designing the apparatus in such a manner as to heat the medium 1 of such a temperature, particularly a low temperature, directly to the temperature $T_1$ or $T'_1$ by the heating section 4 so as to set up a uniform transparent or decolored state is undesirable from the size and cost standpoint. In the light of this, the heating section 2 heats the medium 1 entered the apparatus from the temperature $T_1$ or $T'_1$ to the softening range of high molecules, preferably $T_2$ or $T'_2$. Before the heating section 2 so heats the medium 1, the temperature sensor 7 senses the temperature of the incoming medium 1 and feeds it back to the temperature control circuit 9. In response, the control circuit 9 determines a heating time, temperature distribution, running time and so forth for driving the heating member 8. Subsequently, the cooling section 3 cools the medium 1 to $T_0$ or $T'_0$ to the temperature near room temperature. This allows the processing temperatures of the heating section 4 and successive sections to be set up with a minimum of irregularity, thereby insuring an image having a uniform background and a uniform density.

When the cooling section 3 sharply cools off the medium 1, the medium 1 appears as if it were heated to approximately $T_2$ despite that it has been heated only to approximately $T_1$. While the rapid cooling occurs in about 0.5 second or less after the medium 1 has moved away from the heating section 2, it is delayed when the thermal capacity of the medium 1, including the thermosensitive material, is great. Therefore, while the preferable heating temperature of the heating section 2 is $T_2$ or $T'_2$, the temperature $T_1$ or $T'_1$ is desirable since it is comparable with $T_2$ or $T'_2$ in respect of effect. The heating section 4 heats the medium 1 to the temperature $T_1$ or $T'_1$. As a result, the medium 1 having been clouded or colored by the cooling section 3 is made transparent or decolored. In this way, the heating section 4 determines the background condition of the medium 1, and it is not constantly driven while the apparatus is in operation. Hence, the temperature condition of the writing section 5 which follows the heating section 4 depends on whether or not the heating section 4 is driven. In response to a data signal, the writing section 5 causes the writing member or thermal head 13 to heat the thermosensitive material to $T_2$ or $T'_2$. In this case, if the thermosensitive material has been heated to $T_1$ or $T'_1$ by the heating section 4, energy sufficient to heat it to $T_2$ or $T'_2$ should only be applied to the writing member 13.

Figure 4:
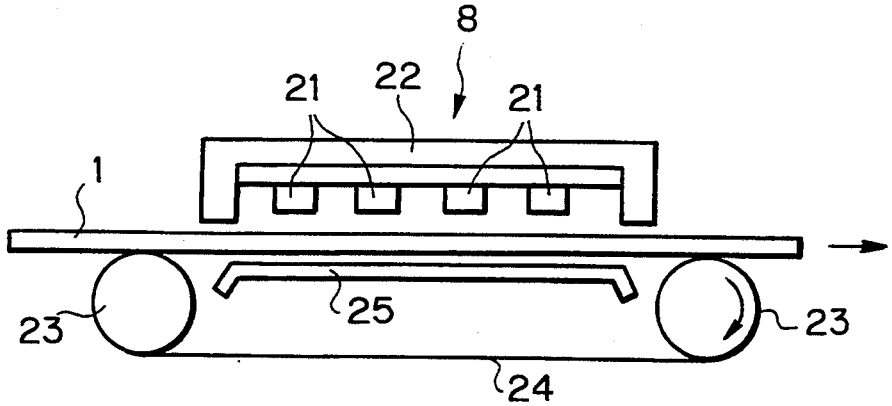
FIG. 4 is a view of a first heating section included in an alternative embodiment of the present invention.

Referring to FIG. 4, an alternative embodiment of the present invention will be described. Since this embodiment is essentially similar to the previous embodiment except for the first heating section 2, the following description will concentrate on the heating section 2. As shown, the heating member 8 of the heating section 2 is implemented as a plurality of heating elements 21 which adjoin or slightly contact the medium 1. A heat insulating material 22 surrounds the top and sides of the heating elements 21. A transport belt 24 is passed over a belt roller pair 23 which is located to face the heating member 8 with the intermediary of the medium 1. A back-up plate 25 is interposed between the opposite runs of the belt 24 and located to face the heating member 8. As the belt 24 is driven by the roller pair 23, it transports the medium 1. Assume that the heating elements 21 are made of a ceramics semiconductor. Then, the heating elements 21 have a low resistance at room temperature, raises the temperature thereof on the supply of a current, and increases the resistance as the Curie point of the material is reached. Therefore, even when the temperature control circuit 9 is absent, the heating member 8 will automatically control the temperature thereof to substantially a constant temperature. When the temperature control circuit 9 controls the heating member 8 in response to the sensed temperature of the medium 1, the number of the heating elements 21 to be driven will be adjusted. The belt 24 and back-up plate 25 may also be implemented as, for example, heating members of ceramics semiconductor or conductive polymer, heating members in the form of foil or fine wire so as to match themselves to the moving speed of the medium 1.

Figure 5:
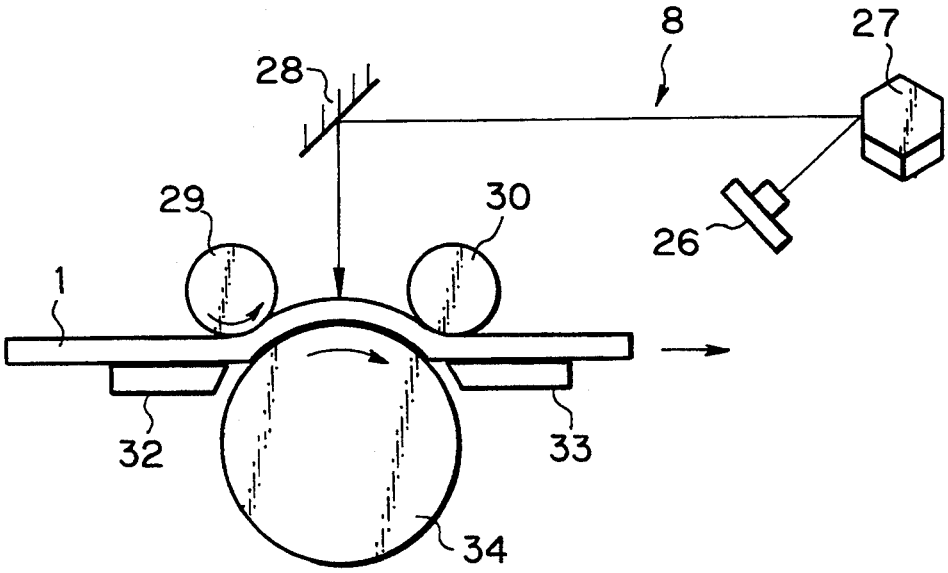
FIG. 5 is a view of a writing section included in another alternative embodiment of the present invention.

FIG. 5 shows another alternative embodiment of the present invention. Since this embodiment is essentially similar to the first embodiment except for the writing section 5, let the following description concentrate on the writing section 5. As shown, the writing section 5 is made up of a semiconductor laser 26, a polygonal mirror 27, and a mirror 28. Upper rollers 29 and 30 are spaced apart from each other in the direction of medium transport. Lower back-up plates 32 and 33 are located to face the upper rollers 29 and 30, respectively. A lower roller 34 is interposed between the back-up plates 32 and 33. As the medium 1 is transported in a direction indicated by an arrow in the figure, the lower roller 34 urges it upward between the upper rollers 29 and 30. As a result, the medium 1 is held in close contact with the lower roller 34 with a small curvature, insuring the focal point of the laser beam from the laser 26. In this configuration, the members 29, 30, 32, 33 and 34 play the role of the heating section 4 in combination. When the diameter of the lower roller 34 is increased, the medium 1 will have a curvature great enough to remain in close contact with the roller 34. Then, the back-up plates 32 and 33 are omissible. As the laser beam issuing from the laser 26 and being steered by the polygonal mirror 27 scans the medium 1, the medium 1 is heated to the temperature $T_2$ or $T'_2$ since the thermosensitive layer of the medium 1 absorbs the beam and transforms it to heat or since a light absorbing layer independent of the thermosensitive material does so.

Figure 6:
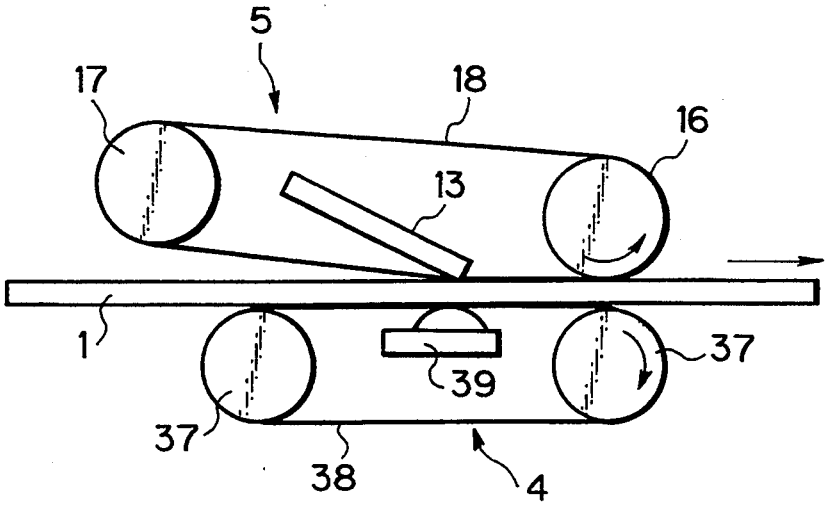
FIG. 6 is a view of a writing section included in a further alternative embodiment of the present invention.

Another alternative embodiment of the present invention will be described with reference to FIG. 6. Since this embodiment is essentially similar to the first embodiment except for the heating section 4 and writing section 5, the following description will concentrate on the two sections 4 and 5. As shown, a belt implemented as an endless heat resistive sheet 38 is passed over a roller pair 37 which is disposed below the transport path of the medium 1. A flat heating member 39 is interposed between the opposite runs of the sheet or belt 38 and positioned to face the writing member 13 of the writing section 5. The sheets or belts 18 and 38 cooperate to transport the medium 1. When the heating member 39 is driven, it heats the medium 1 to the temperature $T_1$ or $T'_1$ to make it transparent or decolored. At this instant, the writing member 13 heats the medium 1 to the temperature $T_2$ or $T'_2$ to cloud or color characters or similar data. It is noteworthy that the temperature $T_2$ or $T'_2$ is achievable with energy smaller in an amount corresponding to the temperature elevation effected by the heating member 39. The resulting medium 1 carries cloudy or colored characters on a transparent or decolored background. When the heating member 39 is not driven, the background of the medium 1 is cloudy or colored after the medium 1 has moved away from the heating section 2 and cooling section 3. Then, characters or similar data are transparent or decolored. Hence, the writing member 13 heats the medium 1 to the temperature $T_1$ or $T'_1$. In this way, the heat/non-heat condition of the heating section 4 and the temperature elevation of the medium 1 at the writing section 5 are related to each other. The heating section 4 is usually operative and may be made inoperative by a switch. Alternatively, an arrangement may be made such that the writing section 5 heats the medium 1 to the temperature $T_1$ or $T'_1$ while the heating section 4 is continuously driven. Then, the heating temperature of the heating section 4 will be selected to be lower than the temperature $T_1$ or $T'_1$ of the writing section 5.

Figure 7:
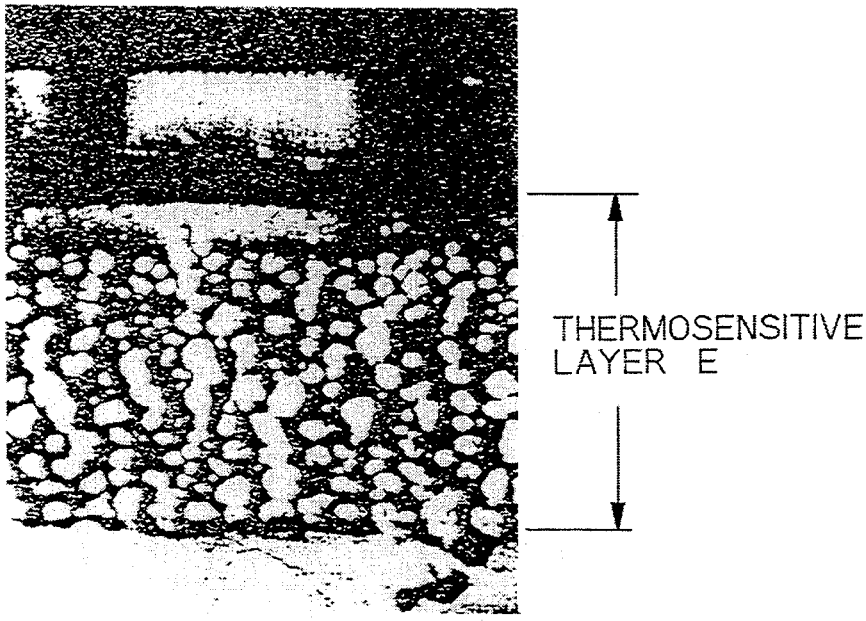
FIG. 7 shows a thermosensitive layer included in a thermosensitive recording medium in an initial state.
Figure 8:
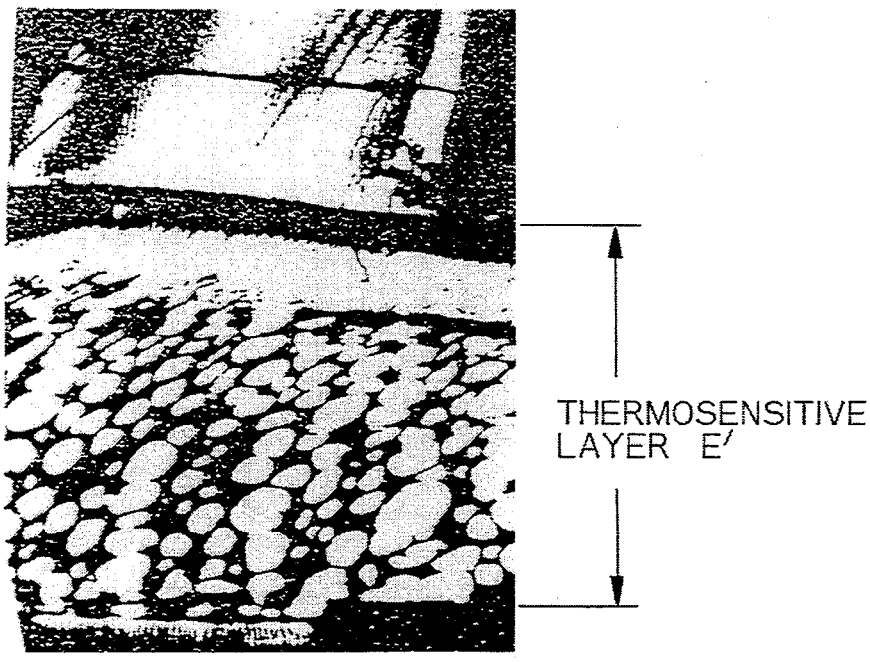
FIG. 8 shows a thermosensitive layer undergone 500 times of writing.

To implement the medium 1 having the characteristic shown in FIG. 2 or 3, a recording layer may be constituted by a dispersed film of high and low molecular substances, the low molecular substance having a particle size of $0.1\mu$ to $1\mu$. Then, if the particles are polycrystalline, the medium 1 will become cloudy by diffusing incident light; if the particles are large crystals, the medium 1 will become transparent. To cause the medium 1 to repetitively color and decolor, a recording layer may be constituted by a color coupler, a developing and decoloring agent, and a binder. For experiment, a thermosensitive material of the above-mentioned high and low molecular substance type was repetitively heated by a thermal head to determine the rate of deterioration due to the repetitive cloudy and transparent states. The experiment showed that the particles of the low molecular substance changes as shown in FIGS. 7 and 8, obviously deteriorating the thermosensitive material. Specifically, FIGS. 7 and 8 show respectively a thermosensitive layer E in the initial state and a thermosensitive layer E' undergone 500 times of writing. In the thermosensitive layers E and E', the particles of the low molecular substance appear white. In the thermosensitive layer E, the particles of the low molecular substance are comparatively independent of one another although the particle size is irregular. By contrast, in the thermosensitive layer E', the particles of interest have undergone a visible change due to the temperature and have increased in size and deformed in the oblique direction. It is to be noted that although FIGS. 7 and 8 are of the same magnification, the thermosensitive layers E and E' observed are not the same.

The above-described phenomenon can be eliminated if any one of the following measures (1)–(4) is taken.

(1) The pressure to act on the medium 1 is selected such that the particles of the low molecular substance dispersed in the high molecular substance undergo plastic deformation due to the relative movement of the medium 1 and writing member 13, thereby eliminating internal strain.

(2) The heat to act on the medium 1 is selected such that the particles of the low molecular substance dispersed in the high molecular substance undergo plastic deformation due to the relative movement of the medium 1 and writing member 13, thereby eliminating internal strain. (3) As the medium 1 and writing member 13 move relative to each other, the resulting force acting on the particles of the low molecular substance and dependent on the speed of relative movement causes them to undergo plastic deformation, thereby eliminating internal strain. (4) The heat and pressure to act on the medium 1 and the relative speed of the medium 1 and writing member 13 are related such that the heat and force acting on the particles of the low molecular substance cause them to plastically deform, thereby preventing internal strain from accumulating.

The internal strain occur due to the plastic deformation of the particles of the low molecular substance, as follows. When the entire medium 1 is softened by heat, the writing member 13 exerts a pressure on the medium 1. As a result, a moving speed is generated in the medium 1 to bring about the internal strain. Even after the pressure has been cancelled such strain is not removed unless a force opposite to the force caused it to occur is applied to the sheet-like thermosensitive layer. This is also true when only the pressure acts on the medium 1, since the recording layer implemented as the dispersed film cannot maintain full rigidity at room temperature. Further, since the pressure acts on the particles of the low molecular substance dispersed in the high molecular substance, it promotes the coupling of the particles to thereby increase the particle size, as shown in FIG. 8. Therefore, it will be seen that when the writing member 13 is fixed in place and exerts a pressure on the medium 1 for heating it in a short period of time, the moving speeds of the medium 1 and writing member 13 deviate from each other to accelerate the deterioration.

In this connection, in the first embodiment, while the medium 1 is transported by the sheet 18 and pressure roller 19, the writing member 13 writes data in the medium 1. Hence, the medium 1 is free from internal strain and, therefore, from the degradation of an image.

Figure 9:
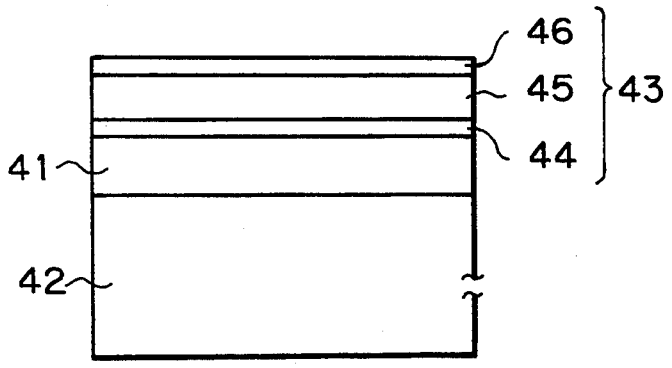
FIGS. 9–11 each shows part of a specific configuration of a thermosensitive recording medium.

A reference will be made to FIGS. 9–11 each showing a specific configuration of the medium 1. FIG. 9 shows a basic structure of the medium 1. As shown, the basic structure has a 20 μm to 0.5 mm thick support layer of resin 42. A thermosensitive layer 41 is applied to the support layer 42 to a thickness of 2 μm to 20 μm. A laminate layer 43 is formed on the thermosensitive layer 41 and made up of a bonding layer 44, a layer 45 formed of polyethylene terephthalate or similar resin, and a heat resistive layer 46. A colored layer, aluminum layer or similar metal layer, or a laser beam absorbing layer is interposed between the layers 41 and 42 in matching relation to the characteristics and objects of the recording material and recording apparatus. When the colored layer is white, it will desirably implement a coloring thermosensitive material. The metal layer will reflect external light and, therefore, increase the apparent clouding or coloring density even when the thermosensitive layer is relatively thin. Regarding the laser beam absorbing layer, when the writing member 13 is implemented by a laser, the layer transforms the optical energy to thermal energy to heat the thermosensitive material.

Figure 10:
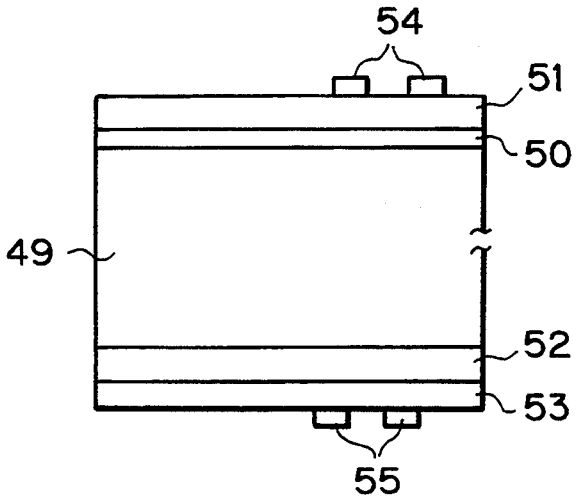

In the configuration shown in FIG. 10, a colored layer 50 and a thermosensitive layer 51 are provided on the top of a resinous support layer 49 while a magnetic layer 52 and a white layer 53 are provided on the bottom of the support layer 49. A printed portion 54 and a color printed portion 55 may be respectively provided on the thermosensitive layer 51 and the white layer 53, if necessary. Although not shown in the figure, an IC (Integrated Circuit) memory, ROM (Read Only Memory) or similar storage may be embedded in the support layer 49, in which case a thermosensitive layer and terminals will be provided on the top of the support layer 49. To write data in the thermosensitive layer 51 or erase it, heat is applied only to the thermosensitive layer 51.

Figure 11:
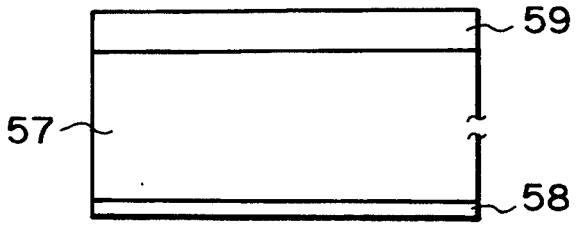

Further, in the structure shown in FIG. 11, a thermosensitive layer 59 and an optical recording layer 58 are provided on the top and the bottom of a support layer 57, respectively.

Figure 12:
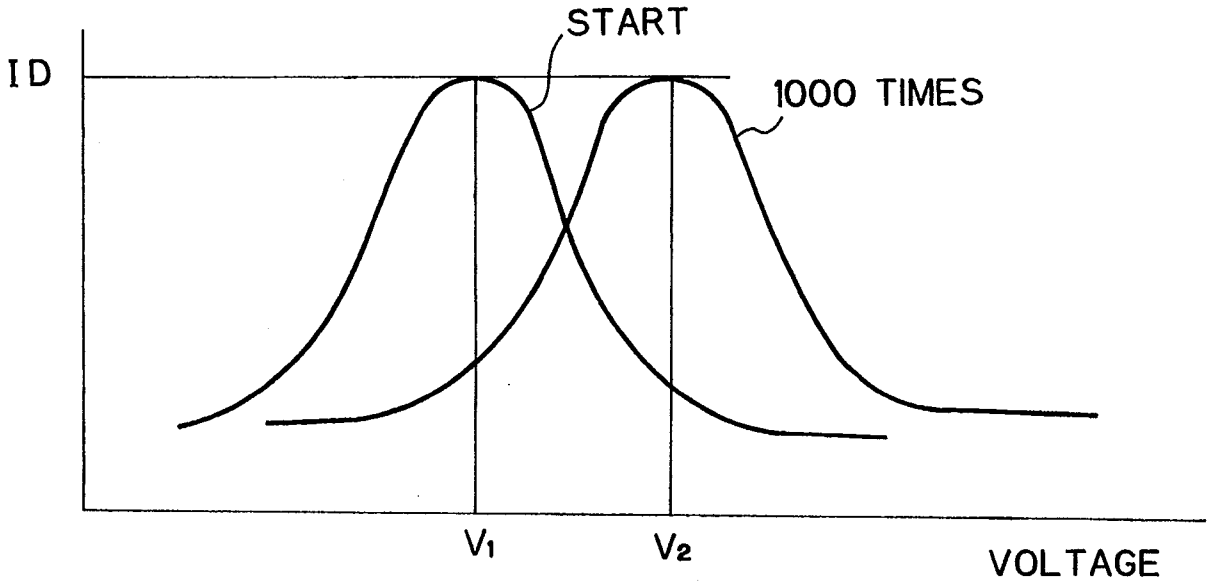
FIG. 12 shows a relation between the cloud density of a thermosensitive material and the voltage applied to a heating member.

Assume a sheet- or card-like recording medium having a storage independent of the thermosensitive material, as mentioned above. Then, the number of times that data has been recorded as well as the dates and times of recording are stored in the storage. A reading device reads such information out of the storage to allow the heating member to be controllably driven and allow the heating condition to be controlled on the basis of the number of times of writing and the number of days having passed after the last writing. This kind of control is desirable for the following reason. The recording apparatus is conditioned such that the particles of the low molecular substance included in the thermosensitive material are prevented from plastically deforming so as to eliminate internal strain, as stated earlier. However, the internal strain of part of the particles of interest accumulate as the medium 1 is repetitively used several hundred times to several thousand times. As a result, the optimal characteristic condition changes, as shown in FIG. 12 whose ordinate and abscissa indicate respectively the could density and the voltage to the writing member 13. As FIG. 12 indicates, in the initial state, i.e., when the thermosensitive material is used for the first time, the highest cloud density is achievable at a voltage $V_1$. However, when the material is used 1,000 times, a voltage $V_2$ is needed to achieve the highest could density. The voltage to the writing member 13 and the voltage to the heating section 2 are each switched over in response to the shift of the voltage from $V_1$ to $V_2$.

In accordance with the present invention, a reversible thermosensitive recording material may be produced by the following procedure. First, there is prepared a solution of base resin and low molecular substance, or a dispersion prepared by dispersing an organic low molecular substance in the form of fine particles in a solution of base resin (use is made of a solvent which does not dissolve at least one of low molecular substances). Spacer particles are dispersed in the solution or the dispersion, as needed. Subsequently, the solution or the dispersion is applied to and dried on a plastic film, glass plate, metal plate or similar support to form a laminate thermosensitive layer. Various kinds of solvents are available for the thermosensitive layer or the thermosensitive recording material and may be selectively used on the basis of the kind of the base resin and that of the organic low molecular substance. Such solvents include tetrahydrofuran, methyl ethyl ketone, methyl isobutyl ketone, chloroform, carbon retrochloride, ethanol, toluene, and benzene. Not only when the dispersion is used but also when the solution is used, the organic low molecular substance is precipitated in the resulting thermosensitive layer as fine particles and exists in the dispersed state.

In accordance with the present invention, the resin used as the base resin or the thermosensitive material should preferably be of the kind capable of forming a film or a sheet, highly transparent, and mechanically stable. For example, use may be made of vinyl polychloride; vinyl chloride-vinyl acetate copolymer, vinyl chloride-vinyla cetate-vinyl alcohol copolymer, vinyl chloride-vinyl acetate-maleic acid coploymer, vinyl chloride-acrylate copolymer or similar vinyl chloride copolymer; vinilidene polychloride, vinyliden polychloride-vinyl chloride copolymer, vinylidene chlorideacrylnitrile copolymer or similar vinylidene chloride copolymer; polyester; polyamide; polyacrylate or polymethacrylate or acrylate-methacrylate copolymer; or cilicone resin. Such resins may, of course, be used either singly or in combination.

On the other hand, the organic low molecular substance should only change from a polycrystalline state to a monocrystalline state in the recording layer when heated and generally has a melting point of 30° C. to 200° C., preferably 50° C. to 150° C. Examples of such a substance are Alkanol; alkanediol; halogen Alkanol or halogen alkanediol; alkylamine; alkane; alkene; alkine; halogen alkane; halogen alken; halogen alkine; cycloalkane; cycloalkene; cycloalkine; saturated or non saturated mono or dicarboxylic acid or an ester thereof, or amide or ammonium salt; aryl carbon acid or an ester thereof, or amid or ammonium salt; thioalcohol; thiocarbon acid or an ester thereof, or amine or ammonium acid; and carboxilic acid ester of thioalcohol. These substances may also be used either singly or in combination. These compounds should have a carbon number ranging from 10 to 60, preferably, 10 to 38, and more preferably 10 to 30. In the ester, the alcohol radical portion may be saturated or nonsaturated and may even be halogenated. In any case, it is preferable that the organic low molecular substance contains at least one of oxygen, nitrogen, sulfur and halogen, e.g., —OH, —COOH, —COHN, —COOR, —NH, —$NH_2$, —S—, —S—S—, —O— and halogen.

More specifically, the above-described compounds may be implemented as higher fatty acids including lauric acid, dodecanoic acid, myristic acid, pentadecanoic acid, palmitic acid, stearic acid, behenic acid, nonadecanoic acid, arachic acid, heneicosanoic acid, tricosanoic acid, lignoceric acid, pentacosanoic acid, cerotic acid, heptacosanoic acid, montanic acid, melicic acid, and oleic acid; esters of higher fatty acids including methyl stearate, tetradecyl stearate, octadecyl stearate, octadecyl laurate, tetradecyl palmitate, dodecyl behenic acid; and ethers and thioethers expressed by the following formulae:

$C_{16}H_{33}—O—C_{16}H_{33}$, $C_{16}H_{33}—S—C_{16}H_{33}$, $C_{18}H_{37}—S—C_{18}H_{37}$, $C_{12}H_{25}—S—C_{12}H_{25}$, $C_{19}H_{39}—S—C_{19}H_{39}$, $C_{12}H_{25}—S—S—C_{12}H_{25}$,

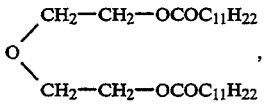

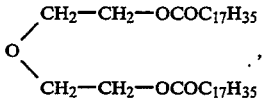

-continued

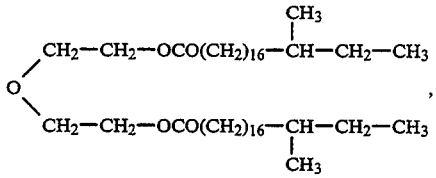

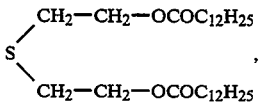

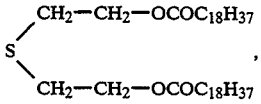

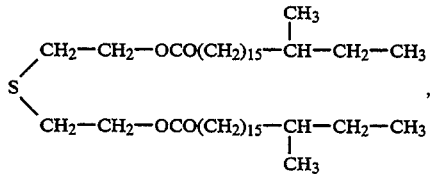

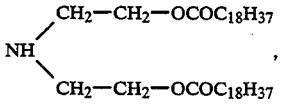

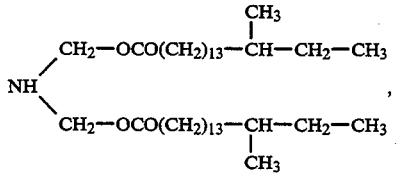

Among them, higher fatty acids, particularly palmitic acid, pendadecanoic acid, nonadecanoic acids, arachic acid, heneicosanoic acid, tricosanoic acid, stearic acid, behenic acid and lignoceric acid whose carbon numbers are greater than 16, are preferable. More preferably, the carbon number should range from 16 to 24.

To broaden the temperature range which can make the thermosensitive material transparent, the various organic low molecular substances mentioned in the specification may be suitably combined or may be combined with other materials having different melting points. For such combinations, a reference may be made to Japanese Patent Laid-Open Publication Nos. 39378/1988 and 130380/1988 and Japanese Patent Application Nos. 14754/1988 and 140109/1988 by way of example.

The ratio between the organic low molecular substance and the base resin constituting the thermosensitive layer is preferably 1:2 to 1:6, more preferably 1:2 to 1:6. Should the ratio of the base resin be less than such a ratio, it would be difficult to form the film of the low molecular substance in the base resin. On the other hand, should it be greater than such a ratio, it would be difficult to make the layer opaque due to the short low molecular substance.

Preferably, the thermosensitive layer should be 1 μm to 30 μm thick, more preferably 2 μm thick to 20 μm thick. If the layer is excessively thick, a heat distribution will occur in the layer to prevent the layer from being made uniformly transparent. If the layer is excessively thin, the degree of clouding will decrease to degrade contrast. To enhance clouding, the amount of organic low molecular substance may be increased.

To facilitate the formation of a transparent image, a surface active agent, a solvent having a high melting point and other additives may be added to the thermosensitive layer in addition to the above-described components. Examples of such additives are as follows.

<Solvent with High Melting Point>

Tributyl phosphate, tri-2-ethylhexyl phosphate, triphenyl phosphate, tricresyl phosphate, butyl oreic acid, dimethyl phthalate, dietyl phthalate, dibutyl phthalate, diheptyl phthalate, di-n-octyl phthalate, di-2-ethylhexil phthalate, diisononyl phthalate, dioctyldecyl phthalate, diisodecyl phthalate, butylbenzile phthalate, dibutyl adipate, di-n-hexyl adipate, di-2-ethylhexyl adipate, di-2-etylhexyl azelate, dibutyl sebacate, di-2-ethylhexyl sebacate, diethyleneglycol dibenzoate, triethyleneglycol-di-2-ethylbutylate, ricinoleic acid butyl, butylphthal butylglycolate, and acetyl citric acid tributyl.

<Surface Active Agent & Others>

Polyhydric alcohol higher fatty acid ester; polyhydric alcohol alkylether; polyhydric alcohol higher fatty acid esters, higher alcohol, higher alkylphenole, higher fatty acid higher alkylamine, higher fatty acid amide, lower olefine oxide additives of fat and oil or polypropyrene glycol; acetylene glycol; Na, Ca, Ba or Mg salt of higher alkylbenzene sulphite; Ca, Ba or Mg salt of higher fatty acid, aromatic carboxilic acid, higher fatty acid sulfonic acid, aromatic sulfonic acid, and monoester sulfate or mono or diester phosphate; lower sulfonated oil; poly long-chain alkylmethacrylate; long-chain alkylmethacrylate~amine-containing monomer copolymer; and stylene~maleic anhydride copolymer.

In accordance with the present invention, the support for the reversible thermosensitive recording material is implemented as, for example, a plastic film, glass plate or metal plate, as previously stated.

To enhance the image contrast of the recording material, a reflection layer may be provided on the rear of the recording layer. Then, a high contrast is achievable even when the recording layer is thinned. Specifically, Al, Ni, Sn, Au, Ag or similar substance may be deposited by vacuum evaporation (see Japanese Patent Application No. 14079/1989).

When the support is constituted by, for example, an Al layer which sparingly bonds to resin, a bonding layer may be provided between the support and the thermosensitive layer (see Japanese Patent Laid-Open Publication No. 7377/1991).

Further, in accordance with the present invention, a protection layer may be provided on the thermosensitive layer to prevent the surface of the thermosensitive layer from deforming due to the heat and pressure of the thermal head or similar thermal writing means, i.e., to prevent the degree of transparency from decreasing. The protection layer (0.1 μm to 10 μm thick) may be made of silicone rubber, silicone resin (see Japanese Patent Laid-Open Publication No. 221087/1988), polysiloxane graftpolymer (see Japanese Patent Laid-Open Publication No. 317385/1988), ultraviolet (UV) ray hardening resin, or electronic ray hardening resin (see Japanese Patent Laid-Open Publication No. 566/1990). In any case, a solvent is used in the event of application. It is preferable that the solvent sparingly dissolves the resin and organic low molecular substrance of the thermosensitive layer. For such a solvent, use may be made of n-hexane, methylalcohol, ethylalcohol or isopropylaclohol by way of example; alcohol-based solvent is desirable from the cost standpoint.

An intermediate layer may be provided between the protection layer and the reversible recording material to protect the recording material from the solvent and monomer component contained in the solution for forming the protection layer (see Japanese Patent Laid-Open Publication No. 133781/1989. The intermediate layer may be implemented by any one of the following thermosetting resins and thermoreversible resins in addition to the previously stated base resins for the thermosensitive layer. The thermosetting resins are, for example, polyethylene, polypropyrene, polystyrene, polyvinyl alcohol, polyvinyl butyral, polyurethane, saturated polyester, nonsaturated polyester, epoxy resin, phenol resin, polycarbonate, and polyamide. The intermediate layer should preferably be 0.1 μm to 2 μm thick although the thickness depends on the application. Thicknesses smaller than such a range would degrade the protection effect while thicknesses greater than the same would lower thermal sensitivity. In addition, a magnetic recording layer may be provided to implement a card (see Japanese Utility Model Laid-Open Publication No. 3876/1990).

In accordance with the present invention, the support of the thermosensitive recording medium may be constituted by paper, synthetic paper, plastic film, etc. A recording layer is formed on the support and contains a leuco compound, a developing and decoloring agent and a binder as major components and additives. A protection layer may be provided on the recording layer, if necessary.

Examples of the leuco compound, developing and decoloring agent ant additives are as follows.

<Leuco Compound>

3-cyclohexylamino-6-chlorofluoran
3-cyclohexylamino-6-promofluoran
3-diethylamino-7-chlorofluoran
3-diethylamino-7-promofluoran
3-dibutylamino-7-chlorolfluoran
3-diethylamino-6-chloro-7-phenylamino-fluoran
3-pyrrolydino-6-chloro-7-phenylamine-fluoran
3-diehtylamino-6-chloro-7-(m-trifluoromethylphenyl)amine-fluoran
3-cyclohexylamino-6-chloro-7-(o-chlorophenyl)amino-fluoran
3-diethylamino-6-chloro-7-(2',3'dichlorophenyl)amine-fluoran
3-diethylamino-6-methyl-7-chlorofluoran
3-dibutylamino-6-chloro-7-etoxyethylamino-fluoran
3-diethylamino-7-(o-chlorophenyl)amino-fluoran
3-diethylamino-7-o-(promophenyl)amino-fluoran
3-dibutylamino-7-(o-fluorophenyl)amino-fluoran
6'-promo-3'-methoxybenzoindrino-pyrylospiran
3-(2'-methoxy-4'-dimethylaminophenyl)-3-(2'-hydroxy-4'-chloro-5'-chlorophenyl)phthalide
3-(2'-hydroxy-4'-dimethylaminophenyl)-3-(2'-methoxy-5'-chlorophenyl)phthalide
2-{3,6-bis(diethylamino)}-9-(o-chlorophenyl)amino-xaltil lactam benzoate
3-N-ethyl-N-isoamylamino-7-chlorofluoran
3-diethylamino-6-methyl-m-trifluoromethylanylino-fluoran 3-pyrrolydino-6-methyl-7-m-trifluoromethylanylino-fluoran 3-(N-cyclohexyl-N-methyl)amino-6-methyl-7-m-trifluoromethylanylinofluoran 3-morpholino-7-(N-n-propyl-N-m-trifluoromethyl-phenyl)aminofluoran <Developing & Decoloring Agent>

(1) Organic phosphates expressed by a general formula:

$$R—PO(OH)_2 \quad (1)$$

where R is representative of straight chain or branched alkyl radicals or alkenyl radicals having a carbon number of 12 or above.

The organic phosphates include octyl phosphonic acid, nonyl phosphonic acid, decyl phosphonic acid, dodecyl phosphonic acid, tetradecyl phosphonic acid, hexadecyl phosphonic acid, octadecyl phosphonic acid, eicosyl phosphonic acid, docosyl photphonic acid, and tetracosyl phosphonic acid.

(2) Organic acids having a hydroxyl group at α-carbon, as expressed as:

$$R_1—CH(OH)COOH \quad (2)$$

where $R_1$ is representative of straight chain or branched alkyl radicals or alkenyl radicals having a carbon number of 12 or above.

Such organic acids include α-hydroxyoctanoic acid, α-hydroxydodecanoic acid, α-hydroxytetradecanoic acid, α-hydroxyhexadecanoic acid, α-hydroxyoctadecanoic acid, α-hydroxypendadecanoic acid α-hydroxyeicosanoic acid, and α-hydroxydecosanoic acid.

(3) Dibasic acids expressed by a general formula:

$$R_2—Zm—\underset{\underset{CH_2—COOH}{|}}{CH}—COOH \quad (3)$$

where $R_2$ is representative of straight chain or branched alkyl radicals or alkenyl radicals having a carbon number of 12 or above, Z is representative of oxygen atoms or sulfur atoms, and m is an integer of 0, 1 or 2.

The dibasic acides expressed by the formula (3) include octyl succinic acid, decyl succinic acid, dedecyl succinic acid, tetradecyl succinic acid, hexadecyl succinic acid, octadecyl succinic acid, eicosyl succinic acid, docosyl succinic acid, tetracosyl succinic acid, octyl malic acid, decyl malic acid, dodecyl malic acid, tetrodecyl malic acid, hexadecyl malic acid, octadecyl malic acid, eicosyl malic acid, decosyl malic acid, tetracosyl malic acid, octyl thiomalic acid, decyl thiomalic acid, dedecyl thiomalic acid, tetradecyl thiomalic acid, hexadecyl thiomalic acid, octadecyl thiomalic acid, eicosyl thiomalic acid, decosyl thiomalic acid, tetracosyl thiomalic acid, octyldithiomalic acid, decyldithio malic acid, dodesyldithio malic acid, tetradecyldithiomalic acid, hexadecyldithiomalic acid, octadecyldithiomalic acid, eicosyldithiomalic acid, decosyldithiomalic acid, and tetracosyldithiomalic acid.

(4) Dibasic acids expressed by a general formula:

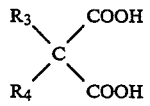

(4)

where $R_3$ indicates straight chain or branched alkyl radicals or elkenyl radicals having a carbon number of 12 or above, and $R_4$ indicates alkyl radicals having one two thirty hydrogen atoms or carbon atoms.

The dibasic acids expressed by the formula (4) include octyl malonic acid, decyl malonic acid, dodecyl malonic acid, tetradecyl malonic acid. hexadecyl malonic acid, octadecyl malonic acid, eicosyl malonic acid, decosyl malonic acid, tetracosyl malonic acid, dioctyl malonic acid, didecyl malonic acid, didodecyl malonic acid, ditetradecyl malonic acid, dihexadecyl malonic acid, dioctadecyl malonic acid, dieicosyl malonic acid, didocosyl malonic acid, methyloctaldecyl malonic acid, methyleicosyl malonic acid, methyldecosyl malonic acid, methyltetracosyl malonic acid, ethylactadecyl malonic acid, ethyleicosyl malonic acid, ethyldocosyl malonic acid, and ethyltetracosyl malonic acid.

<Binder>

The binder may be selected from polyvinyl alcohol, hydroxyethyl cellulose, hydoxypropyl cellulose, methoxy cellulose, carboxymethyl cellulose, methyl cellulose, celulose acetate, gelatin, case:n, starch, soda polyacrylate, polyvinyl pyrrolidone, polyacryl amide, maleic acid copolymer, acrylic acid copolymer, polystyrene, vinyl polychloride, vinyl polyacetate, polyacrylate esters, polymetacrylate esters, vinyl chloride/vinyl acetate copolymer, styrene copolymer, polyester, and polyurethane.

<Additive>

Various kinds of additives are suitably added to the recording layer to control the period of time for erasing a colored image. The additives include phthalate ester, fatty acid ester, phosphate ester and other plasticizers, carnauva wax, parraphin wax, bees wax, polyethylene wax and other wax, dimethyl silicone oil, polyether modified silicone oil, epoxy modified silicone oil and other silicone oil, anion, Nonion and cation surface active agents, lauryl alcohol, stearyl alcohol and other higher alcohol.

By changing the weight percent of the additives to the decoloring agent, it is possible to control the erasing time after writing.

A specific composition of the sheet-like recording medium is as follows:

| | |
|---|---|
| 3-diethylamino-7-(o-chlorophenyl) amino-fluoran | 50 g |
| octadecyl sulphonic acid | 150 g |
| vinyl choloride/vinyl acetate copolymer (VYHH available from Union Carbide) | 150 g |
| dioctyl phthalate | 10 g |
| solvent (toluen/MEK = 1/1) | 1350 g |

The above corn position is pulverized to a particle size of about 3μ by a ball mill and then dispersed to prepare a liquid for forming the recording layer. The liquid is applied to a 75 μm thick PET film to a thickness of about 5 μm by a microgravure coater, and then dried at 80° C. Subsequently, urethane acrylate-based resin which is one of UV hardening resins (Unidick C7-157 available from Dainihon Ink Kagaku) is applied to a thickness of about 3 μm by the microgravure coater, dried at 80° C., and then hardened by an ultraviolet lamp. The resulting sheet-like medium has a protection layer applicable to the present invention.

In summary, it will be seen that the present invention provides a recording apparatus having various unprecedented advantages, as enumerated below.

(1) After the entire thermosensitive material has been uniformly changed, data is written in the material by heat. This insures uniform and stable image quality.

(2) Not only efficient power consumption for heating is promoted, but also a negative or a positive image is achievable, as desired.

(3) Since the pressure acting on a thermosensitive layer is reduced, the particles of a low molecular substance dispersed in a high molecular substance in the thermosensitive material are prevented from plastically deforming. This eliminates the strain of such particles to enhance the durability of the thermosensitive material.

(4) The whole recording apparatus is miniature and low cost.

Various modifications will become possible for those skilled in the art after receiving the teachings of the present disclosure without departing from the scope thereof.

What is claimed is:

1. An apparatus for recording data in a thermosensitive recording medium made of a thermosensitive material which repetitively assumes a cloudy state and a transparent state when heated by particular temperatures corresponding to a data signal, said apparatus comprising:

writing means for writing data in the recording medium by heating said recording medium with a writing member;

first heating means for heating the recording medium at a temperature which causes said recording medium to cloud;

cooling means for cooling the recording medium at a temperature lower than a temperature at which the thermosensitive material reaches a cloud density close to a maximum level; and second heating means for heating the recording medium at a temperature which makes the thermosensitive material transparent;

wherein said first heating means, said cooling means and said second heating means are arranged in this order along a path for transporting the recording medium, and further wherein said first heating means and said cooling means are located upstream of the writing means with respect to the path for transporting the recording medium, and said second heating means are located upstream of or at a same position as said writing means with respect to the path for transporting the recording medium.

2. An apparatus as claimed in claim 1, wherein said second heating means and said writing means are located close to each other or at said same position, said writing means heating the recording medium at a temperature from which a temperature elevation effected by said second heating means is subtracted.

3. An apparatus as claimed in claim 1, wherein said first heating means and said cooling means are located close to each other, said first heating means heating the recording medium at a temperature lower than a temperature necessary for the thermosensitive material to cloud.

4. An apparatus as claimed in claim 1, wherein a temperature elevation level to be effected by said writing member is changed in matching relation to a heat/non-heat condition of said second heating means.

5. An apparatus as claimed in claim 1, wherein said writing member of said writing means comprises a thermal head, a sheet intervening between said thermal head and the thermosensitive material and being movable at a same speed as said thermosensitive recording medium.

6. An apparatus as claimed in claim 1, wherein said writing member of said writing means comprises a semiconductor laser, a back-up roller urging the recording medium upward from a rear of said recording medium at a position where a laser beam from said semiconductor laser is incident on the thermosensitive material.

7. An apparatus as claimed in claim 1, wherein said first and second heating means each comprises one of a heating member produced by applying a conductive polymer to a heat resistive material, a ceramics semiconductor heating member produced by adding a trace of rare-earth element to barium titanate and then baking, a heating member produced by depositing indium tin oxide on a heat resistive material by sputtering, and a heating member produced by covering foil or fine wire of nickel chromium, tungsten or stainless steel with a heat resistive material, said heating member being configured in a flat plate or a hollow cylinder.

8. An apparatus for recording data in a thermosensitive recording medium made of a thermosensitive material which repetitively colors and decolors when heated by particular temperatures corresponding to a data signal, said apparatus comprising:

writing means for writing data in the recording medium by heating said recording medium with a writing member;

first heating means for heating the recording medium at a temperature which causes the thermosensitive material to color;

cooling means for cooling the recording medium at a temperature lower than an upper limit temperature which causes the thermosensitive material having color to decolor; and second heating means for heating the recording medium at a temperature which causes the thermosensitive material to decolor;

wherein said first heating means, said cooling means and said second heating means are arranged in this order along a path for transporting the recording medium, and further wherein said first heating means and cooling means are located upstream of the writing means with respect to the path for transporting the recording medium, and said second heating means are located upstream of or at a same position as said writing means with respect to the path for transporting the recording medium.

9. An apparatus as claimed in claim 8, wherein said second heating means and said writing means are located close to each other or at said same position, said writing means heating the recording medium at a temperature from which a temperature elevation effected by said second heating means is subtracted.

10. An apparatus as claimed in claim 8, wherein said first heating means and said cooling means are located close to each other, said first heating means heating the recording medium at a temperature lower than a temperature necessary for the thermosensitive material to color.

11. An apparatus as claimed in claim 8, wherein a temperature elevation level to be effected by said writing member is changed in matching relation to a heat/-non-heat condition of said second heating means.

12. An apparatus as claimed in claim 8, wherein said writing member of said writing means comprises a thermal head, a sheet intervening between said thermal head and the thermosensitive material and being movable at a same speed as said thermosensitive recording medium.

13. An apparatus as claimed in claim 8, wherein said writing member of said writing means comprises a semiconductor laser, a back-up roller urging the recording medium upward from a rear of said recording medium at a position where a laser beam from said semiconductor laser is incident on the thermosensitive material.

14. An apparatus as claimed in claim 8, wherein said first and second heating means each comprises one of a heating member produced by applying a conductive polymer to a heat resistive material, a ceramics semiconductor heating member produced by adding a trace of rare-earth element to barium titanate and then baking, a heating member produced by depositing indium tin oxide on a heat resistive material by sputtering, and a heating member produced by covering foil or fine wire of nickel chromium, tungsten or stainless steel with a heat resistive material, said heating member being configured in a flat plate or a hollow cylinder.

* * * * *